US007597504B2

(12) United States Patent
McNear

(10) Patent No.: US 7,597,504 B2
(45) Date of Patent: Oct. 6, 2009

(54) BLOCKS FOR MODULAR WALL CONSTRUCTION

(76) Inventor: Jeffrey McNear, 650 Via Casitas, Greenbrae, CA (US) 94904

( * ) Notice: Subject to any disclaimer, the term of this patent is extended or adjusted under 35 U.S.C. 154(b) by 603 days.

(21) Appl. No.: 11/312,170

(22) Filed: Dec. 19, 2005

(65) Prior Publication Data

US 2006/0130420 A1 Jun. 22, 2006

Related U.S. Application Data

(60) Provisional application No. 60/638,564, filed on Dec. 21, 2004.

(51) Int. Cl.
*E02D 17/00* (2006.01)

(52) U.S. Cl. ..... 405/284; 52/285.1; 52/565; 52/604; 52/747.12

(58) Field of Classification Search ..... 52/575, 52/285.1, 285.4, 564, 604, 747.12; 405/262, 405/284, 286; 411/452, 451.4, 487, 923; 403/292

See application file for complete search history.

(56) References Cited

U.S. PATENT DOCUMENTS

| | | | | | |
|---|---|---|---|---|---|
| 798,706 | A | * | 9/1905 | Rockwell | 403/292 |
| 815,641 | A | * | 3/1906 | Schoeneman | 52/607 |
| 821,025 | A | * | 5/1906 | Davies | 411/452 |
| 1,795,451 | A | * | 3/1931 | Sharpe | 52/314 |
| 1,978,145 | A | * | 10/1934 | Heyman | 411/452 |
| 4,454,699 | A | * | 6/1984 | Strobl | 52/585.1 |
| 4,860,505 | A | * | 8/1989 | Bender | 405/286 |
| D319,885 | S | * | 9/1991 | Blomquist et al. | D25/118 |
| 5,044,834 | A | * | 9/1991 | Janopaul, Jr. | 405/284 |
| D340,176 | S | * | 10/1993 | Landsberg | D8/70 |
| 5,252,017 | A | * | 10/1993 | Hodel | 411/446 |
| D341,215 | S | * | 11/1993 | Blomquist et al. | D25/118 |
| D346,667 | S | * | 5/1994 | Blomquist et al. | D25/113 |
| D352,789 | S | * | 11/1994 | Adam | D25/113 |
| D363,787 | S | * | 10/1995 | Powell | D25/118 |
| 5,642,968 | A | * | 7/1997 | Anderson et al. | 405/286 |
| 5,827,015 | A | * | 10/1998 | Woolford et al. | 405/286 |
| 6,168,354 | B1 | * | 1/2001 | Martin et al. | 405/284 |
| 6,398,458 | B1 | * | 6/2002 | Pacitto et al. | 405/286 |
| 6,474,036 | B2 | * | 11/2002 | Martin et al. | 52/604 |
| 6,488,448 | B1 | * | 12/2002 | Blomquist et al. | 405/284 |
| 6,527,483 | B1 | * | 3/2003 | Agee | 405/284 |

(Continued)

*Primary Examiner*—Robert J Canfield
*Assistant Examiner*—James J Buckle, Jr.
(74) *Attorney, Agent, or Firm*—Townsend and Townsend and Crew, LLP

(57) ABSTRACT

A block and peg combination for a modular wall construction is disclosed including a cast block of cementations material having a front face, a rear face, two sides with each side extending between an edge of the front face and an edge of the rear face, a bottom, and a top parallel to the bottom. The front face, rear face and two sides are substantially normal to the bottom and top. The front face has a width between the two sides which exceeds the width of the rear face between the two sides whereby the block tapers at the sides from a wide dimension at the front face to a narrower dimension at the rear face for forming curved walls. The bottom defines at least four spaced-apart holes adjacent the respective sides of the block. At least two pegs, each peg having a conical head portion and a shaft portion, are utilized for insertion into the spaced-apart holes on the bottom of the block.

6 Claims, 5 Drawing Sheets

U.S. PATENT DOCUMENTS 6,962,027 B2 * 11/2005 Zawinsky ..... 52/585.1
D551,358 S * 9/2007 Deragon ..... D25/113
2004/0237445 A1 * 12/2004 Kliethermes ..... 52/575

* cited by examiner

BLOCKS FOR MODULAR WALL CONSTRUCTION

CROSS-REFERENCES TO RELATED APPLICATIONS

This is a continuation and claims the priority of provisional patent application No. 60/638,564 filed Dec. 21, 2004.

BACKGROUND OF THE INVENTION

This invention relates to a block and peg combination for the individual blocks of a modular wall construction. More particularly, cast blocks of cementations material accommodate pegs within holes configured at the bottom of the blocks to enable protruding conical heads of the pegs to be gathered to underlying V-shaped grooves for keying overlying courses of blocks to underlying courses of like blocks.

Blocks for the construction of relatively low (on the order of 4-foot) landscape retaining walls are known. Typically, these blocks are formed from cast cementatious material. They typically have a front face, a rear face, and two sides with each side extending between an edge of the front face and an edge of the rear face of the blocks. The blocks when viewed in plan have a trapezoidal shape with the front portion of the blocks constituting a wide dimension and the rear portion of the blocks constituting a narrower portion.

In forming such low walls, the walls are commonly laid in two dispositions. First, the walls can be vertical. Second, the walls can be canted, typically in a direction where the wall leans into the soil which the wall reinforces. In either case, the weight of the masonry of the wall is utilized to reinforce the soil behind the wall, which soil is typically for a garden bed, such as a flower bed.

It is required that such blocks key to one another. There are existing wall systems that utilize knobs on their bottom surfaces to key the course beneath, but these knobs are all integral sections of the wall units. Making knobs in this way has a low material cost compared with pins, and it also has the simplicity and reliability derived from the lack of any additional keying parts. On the negative side, however, making integral-bottom knobs is a more difficult procedure than making flat-bottomed units, and they are also more difficult to package and transport. Such blocks with integral knobs do not stack neatly for storage or shipment.

Various other schemes for keying such blocks are known. For example, in Blomquist et al. U.S. Pat. No. 6,488,448 and in Castonguay et al. U.S. Pat. No. 6,109,906, blocks are shown keyed to one another. These blocks include through holes or grooves in the blocks for accommodating interlocking pegs. The interlocking pegs register to underlying holes or grooves of the blocks to key an overlying course of such blocks to an underlying course of blocks.

Keying schemes to date have not been without disadvantage. Specifically, in some systems, at the time the blocks are keyed with respect to one another, the interlocking pins must be placed and manipulated through the holes of the overlying blocks. At the same time this manipulation occurs, the overlying block must be moved relative to the underlying block. During this relative movement between the respective overlying and underlying blocks, the pin must be manipulated to effectively "feel" for the desired registration between the respective blocks.

There are other known keying schemes. For example in one type of modular wall construction, it is known to place interconnecting pegs at the top of a first course of blocks forming the underlying layer of a modular block wall. Keying elements are then registered to upwardly concave holes within the second course of blocks as it is laid. Registration of holes at the bottom of the second course of blocks to the placed keying elements of the first course of blocks must occur. This registration is complicated. As the blocks approach one another for the desired registration, the view of the mason placing the blocks is obstructed. Typically, the mason simultaneously leans over to observe the required registration while at the same time trying to lower the block. Strain on the mason results. Further, in these keying schemes, pegs with eccentric protrusions are utilized. While such pins key the respective layers one to another, the eccentric nature of the keying part of the pin with respect to the groove can cause peg head shearing during installation. In such shearing, the eccentric cap of the pin is separated from the embedded shaft by torque exerted on the pin during masonry installation as the relatively heavy blocks are moved, one with respect to the other.

BRIEF SUMMARY OF THE INVENTION

A block and peg combination for a modular wall construction is disclosed including a cast block of cementations material having a front face, a rear face, two sides with each side extending between an edge of the front face and an edge of the rear face, a bottom, and a top parallel to the bottom. The front face, rear face and two sides are substantially normal to the bottom and top. The front face has a width between the two sides which exceeds the width of the rear face between the two sides whereby the block tapers at the sides from a wide dimension at the front face to a narrower dimension at the rear face for forming curved walls. The bottom defines at least four spaced-apart holes adjacent the respective sides of the block. At least two pegs, each peg having a concentric head portion and a shaft portion, are utilized for insertion into the spaced-apart holes on the bottom of the block. The head portion of the peg defines a conical surface truncated at its joinder to the shaft, with the width of the truncated conical surface exceeding the width of the shaft. The shaft defines means for forced engagement to each of the at least two spaced-apart holes in the bottom of the block whereby upon insertion of a shaft of the peg, the conical surface protrudes from the top of the shaft with the truncated conical surface abutted to at the bottom surface of the cast block of cementatious material and the conical surface protruding downward from the bottom with a V-shaped elevation profile. The top surface of each block defines at least one V-shaped groove having a cross-section for fully fitting into and snugly accommodating the V-shaped elevation profile of the conical head portion of the peg. The pegs fasten to the bottom of the block at the holes with the shafts within the hole and the conical tops protruding from the bottom. This enables the conical top at the bottom of a cast block of cementatious material to find the V-shaped groove on the top of a like underlying block of cementatious material to snugly key in the bottom of an underlying block to the top of an overlying block at the V-shaped groove. A process of utilizing such blocks to build a wall is disclosed.

This concept combines the ease of installation derived from an integral knob system with manufacturing and packaging advantages of a flat-bottomed system. The pallet of wall units is typically delivered to the job site packaged with their bottom sides up. The installers then simply install the peg knobs into the holes and the units are then ready for installation.

DETAILED DESCRIPTION OF THE INVENTION

Figure 1A:
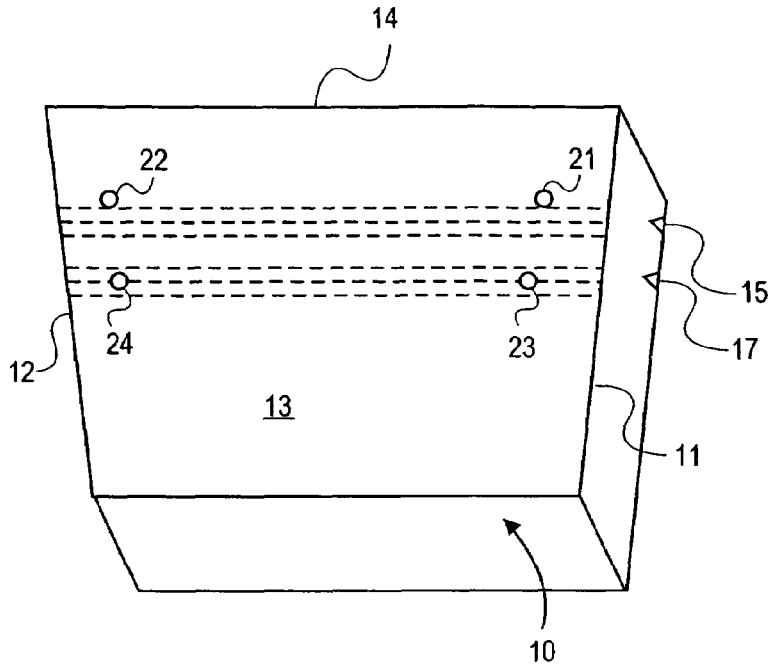
FIG. 1A is a bottom plan view of the block of this invention illustrating overlying V-grooves in the top of the block in broken lines.
Figure 1B:
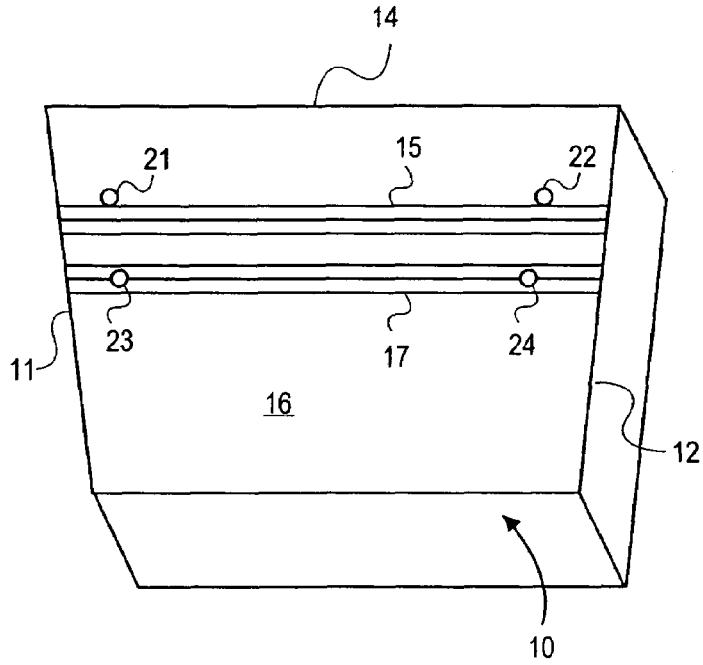
FIG. 1B is a top plan view of the block of FIG. 1A.

Referring to FIGS. 1A and 1B, a block 10 of this invention is illustrated. Specifically, the block has a front face 14, a parallel rear face 16, and sides 11, 12. The block has a trapezoidal profile with the respective front face 14 and parallel rear face 16.

The respective sides 11, 12 are not parallel and converge from front face 14 to and toward narrower rear face 16. This enables front faces 14 of a course of blocks to be given either positive or negative curvature. Where the curvature is positive, the respective sides 11, 12 will be in contact with one another. Where the curvature is negative, the respective sides 11, 12 will be spaced apart and will typically be filled with the material being retained by the wall.

Block 10 has two V-shaped grooves 15, 17 configured in bottom surface 16. As will hereinafter be set forth, the V-shaped grooves register with the conical surface of pins. Likewise, block 10 includes through holes 21 through 24. In the preferred embodiment, these respective holes include holes 23, 24 positioned centrally of groove 17 and holes 21, 22 which are offset from groove 15 toward front face 14. Offset holes 21, 22 are utilized when it is desired to build a canted wall, and registered holes 23, 24 are utilized when it is desired to build a vertical wall.

Figure 2A:
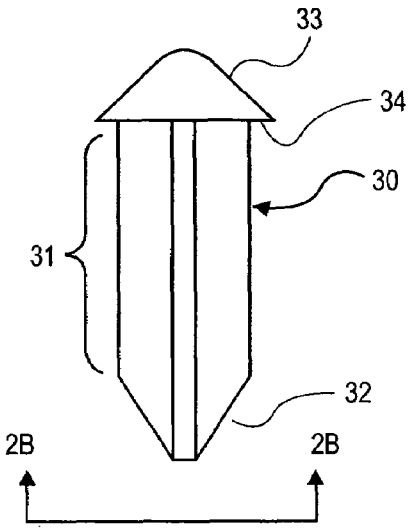
FIG. 2A is a side elevation of a peg utilized for placement into the holes of the block illustrated in FIGS. 1A and 1B.
Figure 2B:
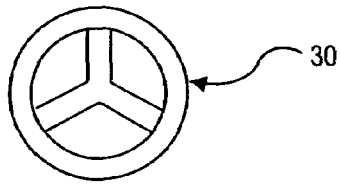
FIG. 2B is a bottom plan view of the peg shown in FIG. 2A.

Referring to FIGS. 2A and 2B, a peg 30 utilized with this invention is illustrated. Specifically, peg 30 includes a shaft 31 and tapers to a point 32 at an end remote from a cap 33. Cap 33 constitutes a complete cone which is configured with the precise elevation configuration of grooves 15, 17. Cap 33 has a dimension which exceeds that of shaft 31. In this manner, underlying ledge 34 of cap 33 abuts directly against bottom surface 13. This limits the penetration of peg 30.

Figure 3:
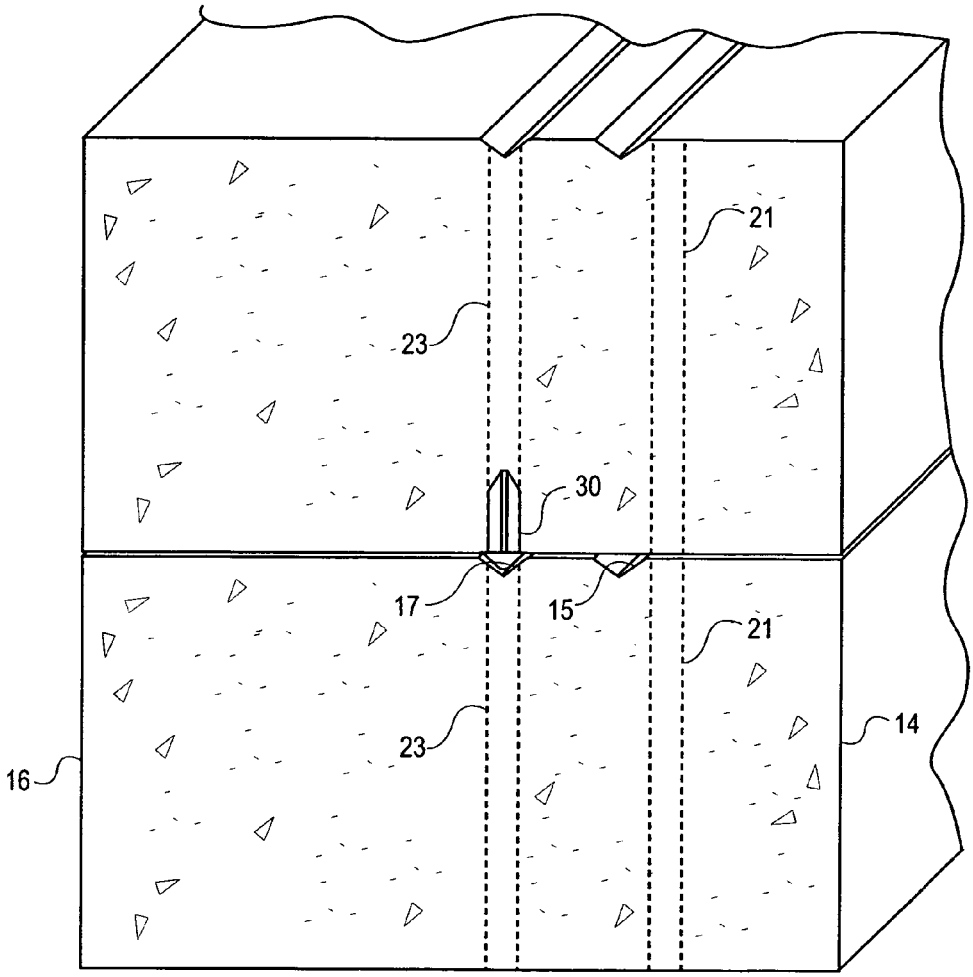
FIG. 3 is a side elevation illustrating joining two blocks to form a vertical wall.

In use, pegs 30 are forced into respective holes 21, 23. Specifically, where a vertical wall is desired, peg 30 is forced into respective holes 23, 24. Further, where a canted wall is desired, peg 30 is forced into respective holes 21, 22. The construction of the vertical wall is illustrated in FIG. 3; a construction of the canted wall is illustrated in FIG. 4.

In the construction of a wall, all blocks are inverted to the position of FIG. 1A. Thereafter, pegs 30 are driven into the respective holes; pegs are driven into holes 21, 22 if a canted wall construction is desired and into holes 23, 24 if a vertical wall construction is desired.

Returning to FIG. 3, for a vertical wall, a first course of blocks 10 is laid at the base of the wall. This course of blocks is without pegs 30. Thereafter, overlying block 10 with its pegs 30 driven into respective holes 23, 24 is registered to the underlying block at its respective groove 17. In such registration, overlying block 10 is placed on the underlying block and moved between its respective front surface 14 and rear surface 16 until registration of peg 30 at conical cap 33 occurs within groove 17. During this movement, the mason will have no view of the registration as it occurs. Rather, he will have a tactile indication from settling movement of the block between cap 33 and groove 17.

Figure 4:
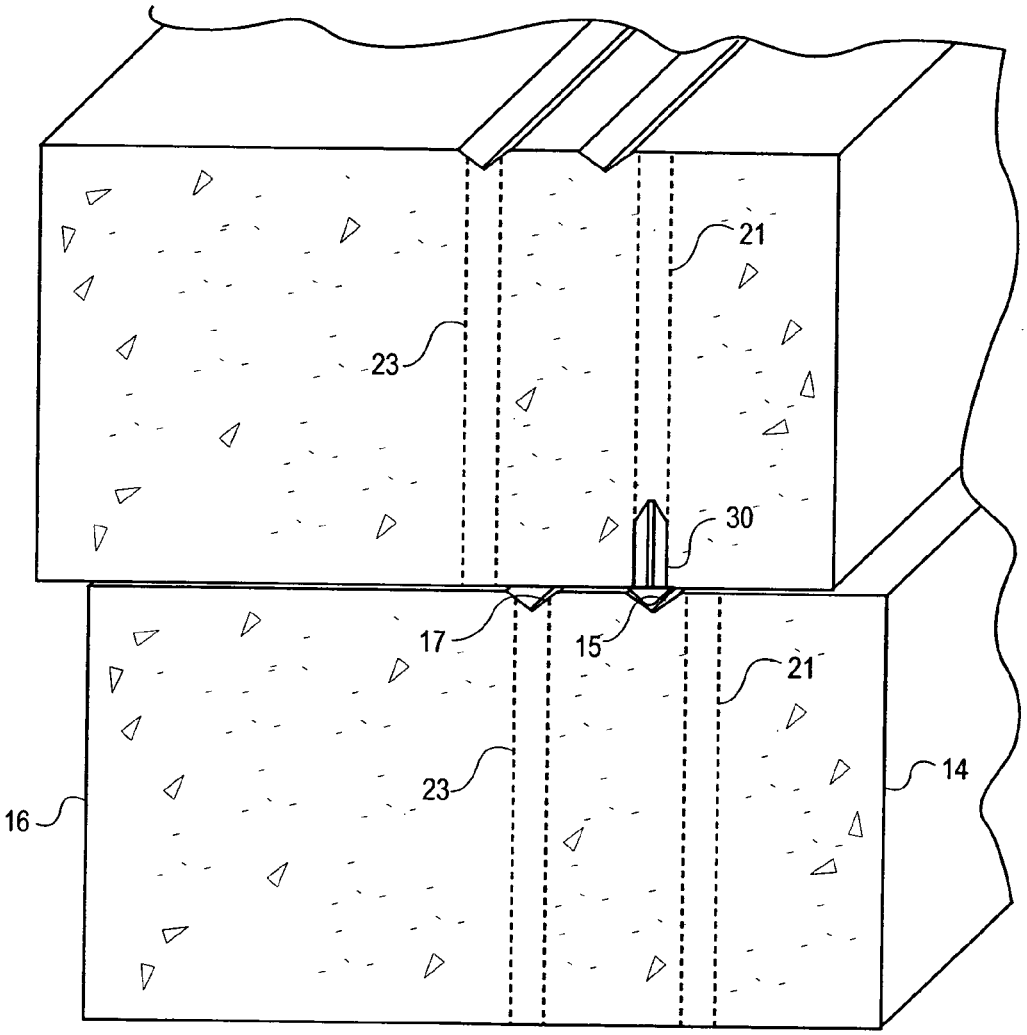
FIG. 4 is a side elevation illustrating joining two blocks to form a slanted wall.
Figure 5:
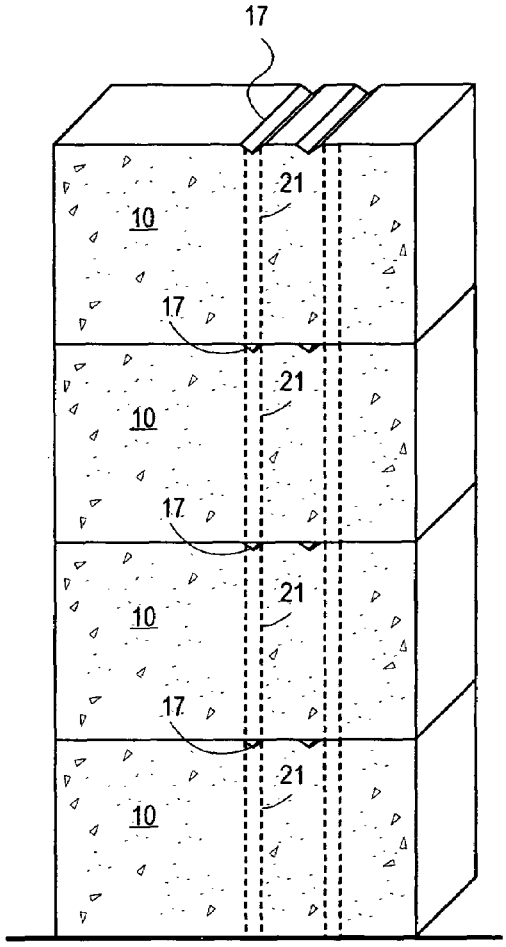
FIG. 5 illustrates a vertical retaining wall made in accordance with this invention.
Figure 6:
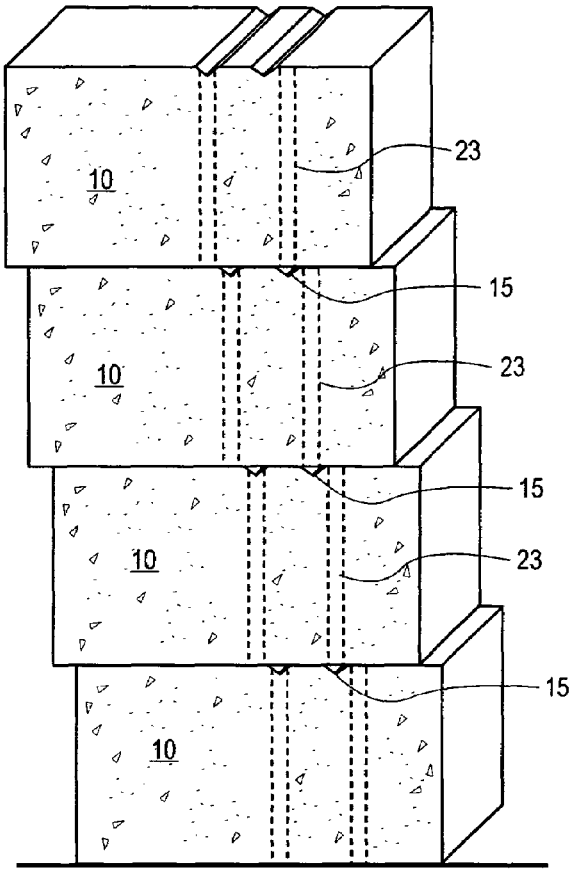
FIG. 6 illustrates a canted retaining wall made in accordance with this invention with the walls sloping back into the soil material it retains.

Referring to FIG. 4, and if a canted wall is desired, a first course of blocks 10 is laid at the base of the wall. This course of blocks will be again without pegs 30. Thereafter, overlying block 10 with its pegs 30 driven into respective holes 21, 22 is registered on the underlying block at its groove 15. Overlying block 10 is placed on the underlying block and moved relative thereto between its respective front surface 14 and rear surface 16 until conical cap 33 of the peg registers in groove 17. The mason will maneuver the block until a tactile indication from settling movement of the block between cap 33 and groove 15 occurs.

What is claimed is:

1. A block and peg combination for a modular wall construction comprising:

a cast block of cementatious material having a front face, a rear face, two sides with each side extending between an edge of the front face and an edge of the rear face;

a bottom, and a top parallel to the bottom, the front face, rear face and two sides being substantially normal to the bottom and top;

the front face having a width between the two sides which exceeds the width of the rear face between the two sides whereby the block tapers at the sides from a wide dimension at the front face to a narrower dimension at the rear face;

one of the top and the bottom defining at least two spaced-apart holes adjacent the respective sides of the block;

at least two pegs, each peg having a head portion and a shaft portion; the head portion of each peg defining a conical top truncated at its joinder to the shaft portion with the width of each truncated conical top exceeding the width of the shaft portion;

each shaft portion being configured for forced engagement in the at least two spaced-apart holes in said one of the top and the bottom of the block so that upon insertion of the shaft portion of one of the pegs in one of the holes, the conical top protrudes from the corresponding hole and the truncated conical surface abuts said one of the top and the bottom surface of the block, the conical top protruding away from said one of the top and the bottom defining a V-shaped elevation profile;

the other one of the top and the bottom defining at least one V-shaped groove having a cross-section configured to snugly receive the V-shaped elevation profile of the head portion of one of the pegs;

the pegs being secured to said one of the top and the bottom of the block at the holes with the shaft portions within the hole and the conical tops protruding from said one of the and the bottom, whereby the conical top at said one of the top and the bottom of a block can register in the V-shaped groove on the other one of the top and the bottom of a like underlying block to snugly key the bottom of an underlying or overlying block to the top of an overlying block at the V-shaped groove.

2. A block and peg combination for a modular wall construction comprising:

a cast block of cementatious material having a front face, a rear face, two sides with each side extending between an edge of the front face and an edge of the rear face;

a bottom, and a top parallel to the bottom, the front face, rear face and two sides being substantially, normal to the bottom and top;

the front face having a width between the two sides which exceeds the width of the rear face between the two sides whereby the block tapers at the sides from a wide dimension at the front face to a narrower dimension at the rear face;

the bottom defining at least four spaced-apart holes adjacent the respective sides of the block;

at least two pegs, each peg having a head portion and a shaft portion;

the head portion of each peg defining a conical top truncated at its joinder to the shaft portion with the width of the truncated conical top exceeding the width of the shaft portion;

each shaft portion being configured for forced engagement with each of the at least two spaced-apart holes in the bottom of the block whereby upon insertion of the shaft portion of one of the pegs in one of the holes, the conical top protrudes from the corresponding hole and the truncated conical top abuts the bottom surface of the block, the conical surface protruding away from the bottom to define a V-shaped elevation profile;

the top surface of the block defining at least two V-shaped grooves having a cross-section configured to snugly receive the V-shaped elevation profile of the head portion of one of the pegs, one of the V-shaped grooves being registered to the respective holes in the bottom of the block, and the other of the V-shaped grooves being offset with respect to respective holes in the bottom of the block;

the pegs being secured to the bottom of the block at the holes with the shaft portions within the hole and the conical tops protruding from the bottom, whereby the conical top at the bottom of a block can register in the V-shaped groove on the top of a like underlying block to thereby snugly key the bottom of an underlying block to the top of an overlying block at the V-shaped groove.

3. A process of constructing a wall from a plurality of block and peg combination comprising the steps of:

providing a plurality of cast blocks of cementatious material, each block having a front face, a rear face, two sides with each side extending between an edge of the front face and an edge of the rear face;

a bottom, and a top parallel to the bottom, the front face, rear face and two sides being substantially normal to the bottom and top;

the front face having a width between the two sides which exceeds the width of the rear face between the two sides whereby the block tapers at the sides from a wide dimension at the front face to a narrower dimension at the rear face;

forming at least two spaced-apart holes in the bottom adjacent the respective sides of the block;

providing at least two pegs, each peg having a head portion and a shaft portion;

the head portion of each peg defining a conical top truncated at its joinder to the shaft portion with the width of the truncated conical top exceeding the width of the shaft portion;

configuring each shaft portion for forced engagement to each of the at least two spaced-apart holes in the bottom of the block so that upon insertion of the shaft portion of one of the pegs in one of the holes, the conical top protrudes from the corresponding hole and the truncated conical surface abuts the bottom surface of the block, the conical top protruding away from the bottom to define a V-shaped elevation profile;

forming at least one V-shaped groove in the top having a cross-section to snugly accommodate the V-shaped elevation profile of the head portion of one of the pegs;

laying a first course of a plurality of blocks having the block tops upwardly exposed in parallel relation with V-shaped grooves of the blocks being also upwardly exposed and respective sides of said blocks being adjacent one another;

placing the pegs in the holes at the bottom of a second course of a plurality of blocks so that the truncated conical tops of the pegs project from the bottom of the second course of the plurality of blocks; and accurately positioning the second course of a plurality of blocks on top of the first course of the plurality of blocks by moving each of the blocks of the second course relative to the blocks of the first course until the truncated tops protruding from the bottoms of the blocks placed on top of the first course of blocks register in the V-shaped grooves of the blocks forming the first course of blocks to thereby key the first and second courses of blocks to each other.

4. A block and peg combination according to claim 1 wherein the at least one V-shaped groove extends along the top from one of the two sides to the other one of the two sides.

5. A block and peg combination according to claim 2 wherein the at least two V-shaped grooves extend along the top from one of the two sides to the other one of the two sides.

6. A process according to claim 3 wherein forming the at least one V-shaped groove comprises extending the groove along the top from one of the two sides to the other one of the two sides.

* * * * *